US006481741B1

(12) United States Patent
Porte

(10) Patent No.: US 6,481,741 B1
(45) Date of Patent: Nov. 19, 2002

(54) SNOWBOARD

(75) Inventor: Pierre-Alain Porte, Seynod (FR)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 09/926,096

(22) PCT Filed: Jan. 11, 2001

(86) PCT No.: PCT/FR01/00074

§ 371 (c)(1),
(2), (4) Date: Aug. 31, 2001

(87) PCT Pub. No.: WO01/54777

PCT Pub. Date: Aug. 2, 2001

(30) Foreign Application Priority Data

Jan. 28, 2000 (FR) ..... 00 01269

(51) Int. Cl.[7] ..... A63C 5/12
(52) U.S. Cl. ..... 280/609; 280/610; 280/14.21
(58) Field of Search ..... 280/602, 610, 280/14.21, 14.22, 607, 609

(56) References Cited

U.S. PATENT DOCUMENTS

| | | | | |
|---|---|---|---|---|
| 5,249,819 A | | 10/1993 | Mayr | 280/602 |
| 5,335,931 A | | 8/1994 | Lacroix et al. | 280/602 |
| 5,366,234 A | * | 11/1994 | Rohrmoser | 280/610 |
| 5,573,264 A | | 11/1996 | Deville et al. | 280/602 |
| 5,649,717 A | * | 7/1997 | Augustine et al. | 280/610 |
| 5,769,445 A | * | 6/1998 | Morrow | 280/610 |
| 5,782,482 A | | 7/1998 | Andrus et al. | 280/602 |
| 5,855,389 A | * | 1/1999 | Andrus et al. | 280/602 |
| 6,059,306 A | * | 5/2000 | Metrot et al. | 280/14.21 X |
| 6,183,000 B1 | * | 2/2001 | Piatti | 280/610 |

FOREIGN PATENT DOCUMENTS

| | | |
|---|---|---|
| EP | 0546309 | 6/1993 |
| EP | 0622096 | 11/1994 |
| EP | 0846479 | 6/1998 |
| EP | 0848968 | 6/1998 |
| FR | 2771644 | 6/1999 |
| WO | WO 90/03205 | 4/1990 |
| WO | WO 97/27914 | 8/1997 |
| WO | WO 99/43397 | 9/1999 |

* cited by examiner

*Primary Examiner*—Michael Mar
(74) *Attorney, Agent, or Firm*—Greenblum & Bernstein, P.L.C.

(57) ABSTRACT

A snowboard having a length, a width, and a height, the latter including in particular a lower reinforcement, an upper reinforcement, and at least one core located between the upper reinforcement and the lower reinforcement. The thickness of each core is demarcated by two surfaces of the core parallel to one another, and at least one of the cores has a smaller width than the width of the board in each end zone.

24 Claims, 3 Drawing Sheets

SNOWBOARD

BACKGROUND OF THE INVENTION

1. Field of the Invention

The present invention relates to the field of gliding boards adapted to snowboarding.

2. Description of Background and Relevant Information

A snowboard has a length demarcated by a first end and a second end, a width demarcated by a first edge and a second edge, as well as a height demarcated by an upper surface and a lower surface or gliding surface.

To operate the board, a user has both feet affixed to the upper surface along a substantially transverse direction of the board. Conventionally, the end zones of the board are thinned down, or tapered, so as to deform during the operation. The deformation of an end zone enables the board to accumulate and then to restore energy, in the manner of the end of a blade-shaped spring. Therefore, the user, for example, can cause the elastic deformation of one end, by applying an impulse after shifting the weight of his body toward the end. The energy recovered during the impulses makes it easier to negotiate certain curves or to perform jumps.

The thinning of an end zone is obtained by making a core that is beveled toward each end of the board.

The core is then covered with various layers of materials to obtain the structure of the board.

It is known to select low-density materials to manufacture the core, in order to reduce the board mass. For example, the core can be made of wood, or of a foam of a synthetic material.

The core is shaped by machining an originally flat raw piece. The machining generates mechanical stresses in the raw piece, which tend to tear out portions of the core at the ends. The tearing occurs because the core is very thin at the ends. Therefore, it is necessary to select a material that has an adequate mechanical strength to make a core.

This means that certain low-density materials cannot be used to make a core, due to the fact that they cannot be machined.

This is especially true with wood, in the case where the wood fibers are oriented in the direction of the board thickness.

This is also true with honeycombed materials, such as those in which each of the juxtaposed cells is hexagonal.

SUMMARY OF THE INVENTION

The object of the invention more particularly is a board whose core can be made out of any low-density material.

According to the invention, a gliding board adapted to snowboarding has a length measured along a longitudinal direction between a first end and a second end of the board, a width measured along a transverse direction between a first edge and a second edge, and a height measured between an upper surface and a lower surface or gliding surface, the height in particular including a lower reinforcement, an upper reinforcement, and at least one core located between the upper reinforcement and the lower reinforcement, the board also having, from the first to the second end, a first end zone, a first contact line, a first intermediate zone, a first boot retaining zone, a central zone, a second boot retaining zone, a second intermediate zone, a second contact line, and a second end zone.

The thickness of each core is demarcated by two surfaces of the core parallel to one another, and at least one of the cores has a smaller width than the width of the board in each end zone.

This means that the thickness of the core is constant, and that the ends of the core are not beveled. The thickness of the core remains sufficient so that a machined raw piece keeps all of its portions, regardless of its constituent material.

For example, it is possible to make the core out of wood in order that the wood fibers be oriented in the direction of the board thickness. The advantage is that this orientation of the fibers improves the crushing strength of the board, in the direction of the thickness.

It is also possible to manufacture a honeycombed core from a metal such as aluminum, or from a plastic material. The advantage is that the board obtained is lighter than a conventional board and has an increased crushing strength.

In any event, the reduced width of at least one of the cores, at the end zones, enables the board to deform in order to accumulate and restore energy.

BRIEF DESCRIPTION OF THE DRAWING

Other characteristics and advantages of the invention will be better understood from the description that follows, with reference to the annexed drawings showing, by way of non-limiting examples, how the invention can be embodied, and in which.

DETAILED DESCRIPTION OF THE INVENTION

The first embodiment of the invention is described hereinafter by means of FIGS. 1–5.

Figure 1:
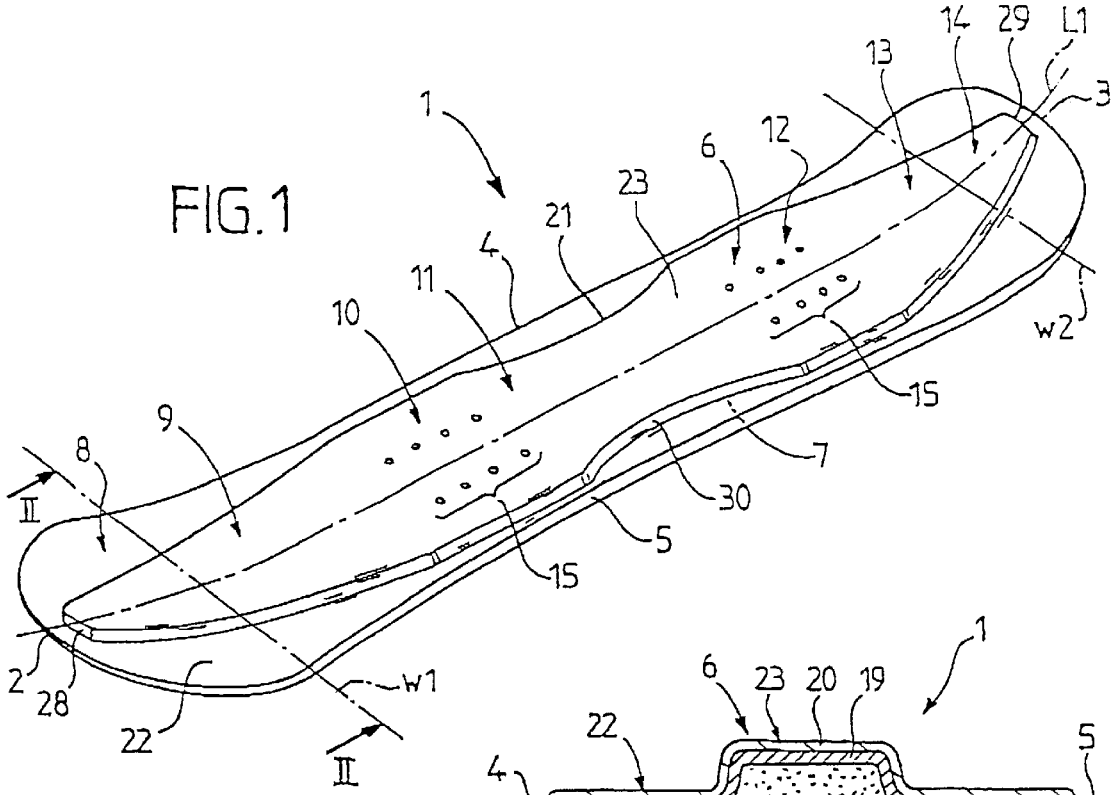
FIG. 1 is a perspective view of a board consistent with the spirit of the invention, according to a first embodiment.

In a known manner, as seen in particular in FIG. 1, the snowboard 1 has a length measured along a longitudinal direction L1 between a first end 2 and a second end 3. The board 1 also has a width measured along a transverse direction between a first lateral edge 4 and a second lateral edge 5, as well as a height measured between an upper surface 6 and a lower surface or gliding surface 7.

Of course, the transverse direction is perpendicular to the longitudinal direction L1, and parallel to the gliding surface 7.

The board 1 also has, from the first end 2 to the second end 3, a first end zone 8, a first contact line W1, a first intermediate zone 9, a first boot retaining zone 10, a central zone 11, a second boot retaining zone 12, a second intermediate zone 13, a second contact line W2, and a second end zone 14.

Each boot retaining zone, or binding zone, 10, 12, is provided to receive a device for retaining the user's foot onto the board. The devices, not shown, can be affixed to the board 1 by a means such as screws. Each binding zone 10, 12 is provided in this regard with threaded openings 15.

Each of the contact lines W1, W2 is a substantially transverse line of the board 1, in the area of which the gliding surface 7 contacts a planar surface when the board 1 is placed on the surface without any external influence.

Figure 2:
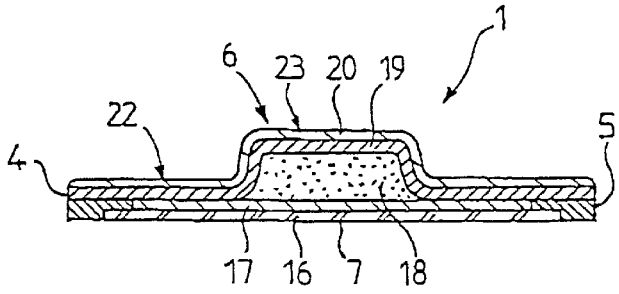
FIG. 2 is a cross-section along the line II—II of FIG. 1.

The height of the board 1 is shown in cross-section in FIG. 2. From the gliding surface 7 to the upper surface 6, the board 1 has a sole 16, a lower reinforcement 17, a core 18, an upper reinforcement 19, and a protective layer 20.

The sole 16 is preferably made out of a plastic material containing polyethylene. The protective layer 20, for example, is made of a plastic material containing acetyl-butadien-styrene.

Each of the reinforcements 17, 19 is preferably made of a fabric of resin-impregnated fibers. The fibers can be made of any material, or of any mixture of materials, such as glass, carbon, aramid, metal or the like. The resin can be thermosetting or thermoforming. The core 18 is made of a low-density material, which makes it possible to reduce the mass of the board 1, as will be explained hereinafter.

Figure 3:
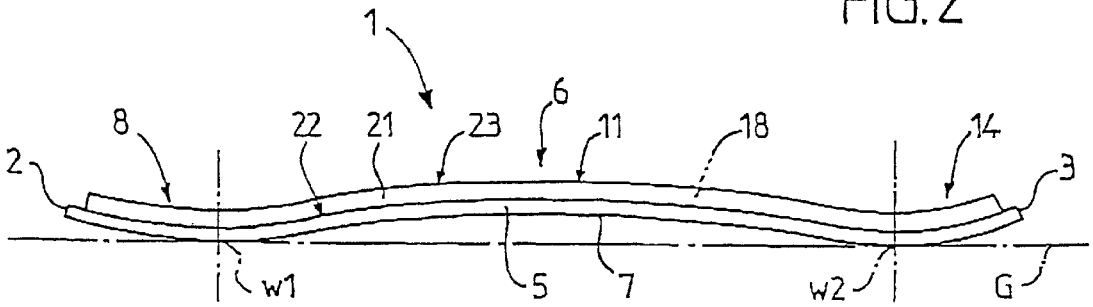
FIG. 3 is a side view of the board of FIG. 1.
Figure 4:
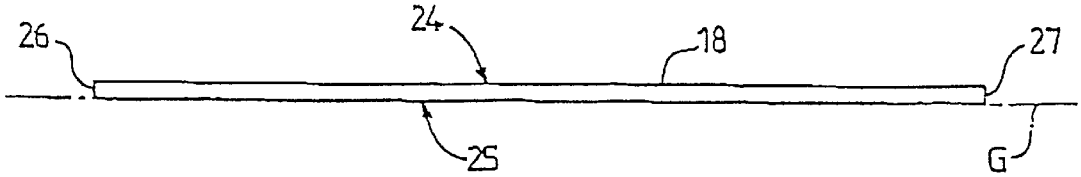
FIG. 4 is a side view of a constituent element of the board of FIG. 1.

According to the invention, as understood in particular by means of FIGS. 3 and 4, the core 18 of the board 1 has a constant thickness. This means that regardless of the area of the board where the core thickness is measured, the resulting value is the same, except for the manufacturing tolerance.

As shown in FIG. 3, the upper surface 6 of the board 1 has a base plate 21, forming an upper base surface 23, projecting with respect to a lower base surface 22. The distance separating the lower base surface 22 from an upper base surface 23 of the base plate 21 is constant, because the thickness of the core 18 is constant, and because the thicknesses of the sole 16, protective layer 20 and reinforcements 17, 19, are constant. The shape of the base plate 21 is substantially the same as that of the core 18.

The board 1 is incurved so as to contact the previously mentioned planar surface only in the area of the contact lines W1, W2. The surface is designated by the reference character G.

The core 18 is shown alone in a side view in FIG. 4. It is made of a raw piece such that its upper surface 24 and lower surface 25 are parallel.

The core 18 can be made of wood arranged such that its fibers are oriented substantially perpendicular to the upper 24 and lower 25 surfaces. In this case, the core 18 is preferably made by flat machining, by facing the upper surface 24. This method has the advantage of being economical.

Given that the thickness of the core 18 is constant, the edges of the core are not torn out during machining. It is possible to use a wood such as balsa, whose density close to 0.15 is lower than that of conventional wood, such as birch or poplar. As a result, the board 1 is lighter. In addition, the vertical orientation of the wood fibers increase the crushing strength of the board 1, even if the wood selected is balsa or an equivalent wood.

The core 18 can also be obtained with a honeycombed structure whose cells are perpendicular to the upper 24 and lower 25 surfaces. This can be a honeycombed structure, for example. One also notes a decrease in the mass of the board 1 and an increase in the compressive strength in the direction of the thickness of the board.

Of course, the core 18 can be made of other materials.

The width of the core 18 varies between its front end 26 and its rear end 27.

Figure 5:
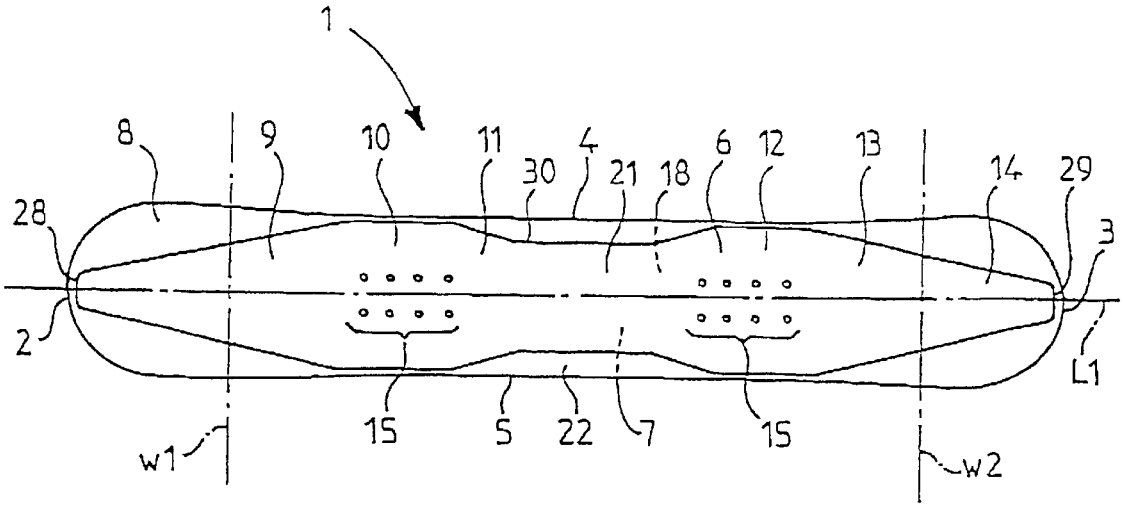
FIG. 5 is a top view of the board of FIG. 1.

The variation in the width of the core 18 translates into a similar variation in the width of the base plate 21, as is clearly seen in FIGS. 1 and 5, in particular. Similarly, the width of both the upper base surface 23 and the lower base surface 22 vary between front end 26 and rear end 27 of the core.

From the end 2 to the end 3 of the board 1, the base plate 21 and the core 18 have a symmetrical shape with respect to a longitudinal median plane that is illustrated by the axis line of the longitudinal direction L1. The core 18 and base plate 21 each extend widthwise from the longitudinal median plane, and on both sides of the latter.

The base plate 21 has a first end 28 located in the vicinity of the first end 2 of the board 1, as well as a second end 29 located in the vicinity of the second end 3 of the board 1.

In each of the end zones 8, 14 of the board 1, the base plate 21 and the core 18 widen out between the end 28, 29 of the base plate and the contact line W1, W2.

Next, the base plate 21 and the core 18 continue to widen out from the contact line W1, W2 up to the binding zone 10, 12, i.e., in the intermediate zone 9, 13. The contour 30 of the base plate 21 remains in the vicinity of the lateral edges 4, 5 of the board 1 in the binding zones 10, 12. Finally, the base plate 21 and the core 18 narrow down toward the middle of the ends 28, 29, so that they are substantially narrower than the lower base surface 22.

From the foregoing, it can be seen that, at least in the first and second end zones 8 and 14 of the board 1, the width of the upper base surface 23 relative to the width of the lower base surface 22 is less than in other ones of the zones of the board. For example, from the contact lines W1, W2 to the respective ends 2, 3 of the board, the upper base surface 23 is narrowed, whereby a ratio of the upper base surface width to lower base surface width in the end zones 8, 14 is smaller than in other zones of the board, such as in the binding zones 10, 12, for example, whereby the width of the upper base surface extends substantially, if not entirely, across the width of the board.

The core 18 and the base plate 21 still have a width smaller than or equal to the width of the board 1 measured between the lateral edges 4, 5.

In the end zones 8, 14, the widths of the core 18 and of the base plate 21 are preferably comprised between 20% and 60% of the width of the board 1.

In the intermediate zones 9, 13, the widths of the core 18 and of the base plate 21 are preferably comprised between 40% and 80% of the width of the board 1.

In the binding zones 10, 12, the widths of the core 18 and of the base plate 21 are preferably comprised between 75% and 100% of the width of the board 1.

Finally, in the central zone 11 of the board 1, the widths of the core 18 and of the base plate 21 are preferably comprised between 50% and 90% of the width of the board 1.

The decrease in the width of the core 18 in the area of its ends 28, 29, and of the ends 2, 3 of the board 1, provides the board 1 with substantially the same ability to deform in bending along a transverse axis of the board 1 as in the case of a conventional board.

The assembly of the constituent elements of the board 1 is done in a conventional manner. The sole 16, lower reinforcement 17, core 18, upper reinforcement 19, and protective layer 20 are stacked in a mold. Next, a raise in temperature and pressure causes the affixation of the elements.

The other embodiments of a board according to the invention will be described summarily hereinafter by means of FIGS. 6–11. In each case, only the differences with respect to the first embodiment are shown. For this reason, each of the figures serves to show an embodiment, each figure being a cross-section similar to FIG. 2.

Figure 6:
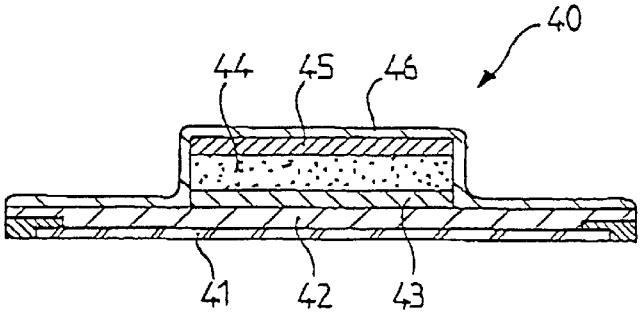
FIG. 6 is a view similar to FIG. 2, according to a second embodiment.

The second embodiment is shown by means of FIG. 6.

A board 40 has a height that includes a sole 41, a lower reinforcement 42, an intermediate reinforcement 43, a core 44, an upper reinforcement 45, and a protective layer 46. During the manufacture of the board 40, it can be provided to first obtain a sub-assembly including only the intermediate reinforcement 43, core 44 and lower reinforcement 45. Next, the sub-assembly is arranged in a mold with the remaining components to obtain the board 40.

Figure 7:
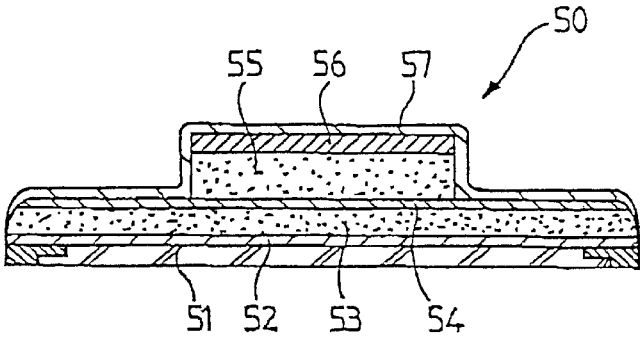
FIG. 7 is a view similar to FIG. 2, according to a third embodiment.

The third embodiment is shown by means of FIG. 7.

A board 50 has a height that includes a sole 51, a lower reinforcement 52, a lower core 53, an intermediate reinforcement 54, an upper core 55, an upper reinforcement 56, and a protective layer 57. During the manufacture of the board 50, it can be provided to first obtain a sub-assembly including only the lower reinforcement 52, lower core 53, and intermediate reinforcement 54. Next, the sub-assembly is arranged in a mold with the remaining components to obtain the board 50.

Figure 8:
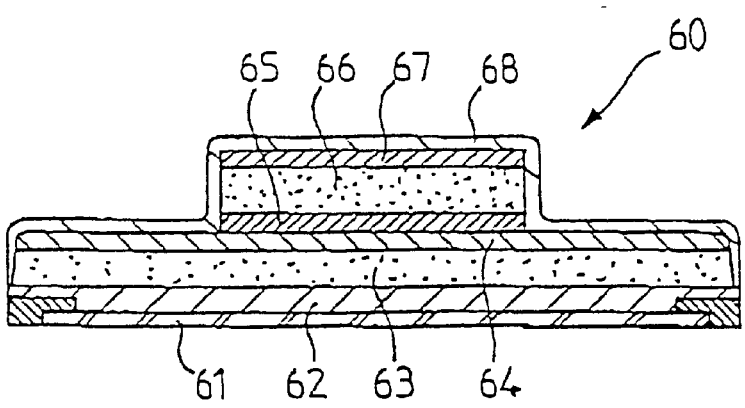
FIG. 8 is a view similar to FIG. 2, according to a fourth embodiment.

The fourth embodiment is shown by means of FIG. 8.

A board 60 has a height that includes a sole 61, a lower reinforcement 62, a lower core 63, a first intermediate reinforcement 64, a second intermediate reinforcement 65, an upper core 66, an upper reinforcement 67, and a protective layer 68. During the manufacture of the board 60, it can be provided to first obtain two sub-assemblies. One of the sub-assemblies includes the lower reinforcement 62, lower core 63, and first intermediate reinforcement 64. The other sub-assembly includes the second intermediate reinforcement 65, upper core 66, and upper reinforcement 67. Next, the two sub-assemblies are arranged in the mold with the remaining components.

Figure 9:
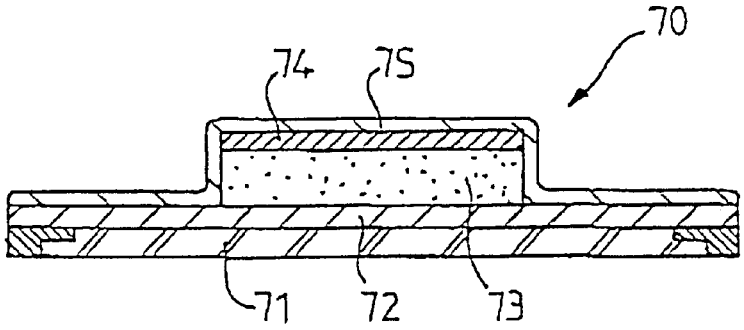
FIG. 9 is a view similar to FIG. 2, according to a fifth embodiment.

The fifth embodiment is shown by means of FIG. 9.

A board 70 has a height that includes a sole 71, a lower reinforcement 72, a core 73, an upper reinforcement 74, and a protective layer 75. The manufacture is carried out according to usual methods.

Figure 10:
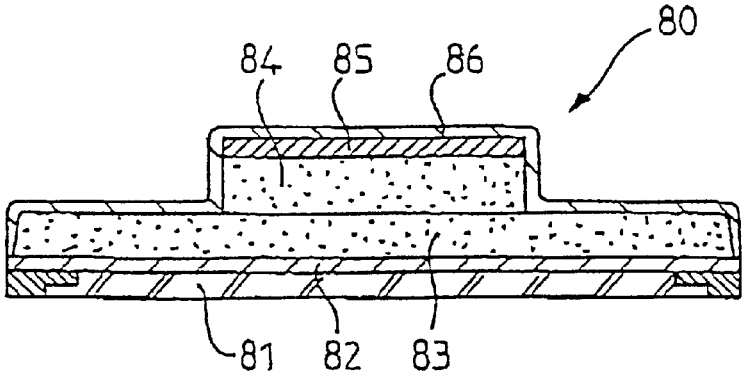
FIG. 10 is a view similar to FIG. 2, according to a sixth embodiment.

The sixth embodiment is shown by means of FIG. 10.

A board 80 has a height that includes a sole 81, a lower reinforcement 82, a first core 83, a second core 84 superimposed on the first core 83, an upper reinforcement 85, and a protective layer 86. The manufacture is carried out according to usual methods.

Figure 11:
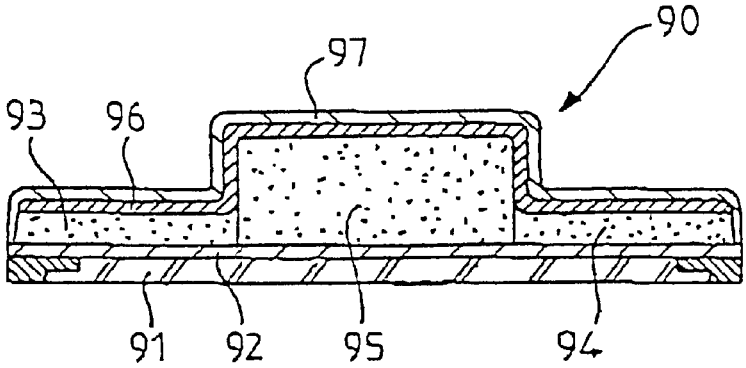
FIG. 11 is a view similar to FIG. 2, according to a seventh embodiment.

The seventh embodiment is shown by means of FIG. 11.

A board 90 has a height that includes a sole 91, a lower reinforcement 92, a first lateral core portion 93, a second lateral core portion 94, a central core portion 95, an upper reinforcement 96, and a protective layer 97. The three portions 93, 94, 95 are juxtaposed. They have different thicknesses. The manufacture of the board is carried out according to usual methods.

Of course, the invention is not limited to the embodiments described hereinabove, and includes all of the technical equivalents that fall within the scope of the claims that follow.

In particular, each core can have diverse variations in width.

Furthermore, the core must be understood as being an integral piece, or a combination of a plurality of pieces. In this second case, the pieces can be juxtaposed, or superimposed, or yet positioned next to one another so as to leave a space.

What is claimed is:

1. A gliding board adapted to snowboarding, said gliding board comprising:

a first end and a second end, said first and second ends defining a length of the board extending in a longitudinal direction;

a first edge and a second edge, said first and second edges defining a width of the board extending in a transverse direction;

an upper surface and a lower or gliding surface, said upper and lower surfaces defining a height of the board;

within said height of the board, the board further comprising a lower reinforcement, an upper reinforcement, and at least one core, said at least one core being located between said upper reinforcement and said lower reinforcement;

between said first end and said second end, the board further comprising a first end zone, a first contact line, a first intermediate zone, a first boot retaining zone, a central zone, a second boot retaining zone, a second intermediate zone, a second contact line, and a second end zone;

each of said at least one core comprising a thickness demarcated by two surface, respectively, said two surfaces being parallel to one another, and at least one of said at least one core having a smaller width than said width of the board in each of said first and second end zones and a thickness providing the gliding board with an upwardly projecting base portion to form an upper base surface;

at least in each of said first and second end zones said upper surface of the board being defined by said upper base surface and a lower base surface, whereby at least in each of said first and second end zones said lower base surface extends laterally of said upper base surface on opposite lateral sides of said upper base surface, and whereby at least in each of said first and second end zones a width of said upper base surface relative to the width of the board is less than in predetermined other ones of said zones.

2. A gliding board according to claim 1, wherein said at least one core has a symmetrical shape with respect to a longitudinal median plane of the board, said at least one core extending widthwise from the longitudinal median plane, on both sides of the longitudinal median plane.

3. A gliding board according to claim 1, wherein at least in one of said intermediate zones said at least one core has a smaller width than said width of the board.

4. A gliding board according to claim 1, wherein said at least one core includes opposite ends, and said core widens out from each of said opposite ends to a respective one of said boot retaining zones the closest to respective ones of said opposite ends.

5. A gliding board according to claim 1, wherein said at least one core includes opposite ends, and said core has a narrowing toward a middle of said opposite ends.

6. A gliding board according to claim 1, where said base portion has a shape substantially the same as a shape of said core.

7. A gliding board according to claim 1, wherein said reinforcements have a substantially constant thickness.

8. A gliding board according to claim 1, wherein said core has a constant thickness between opposite ends of said core.

9. A snowboard comprising:

a first end and a second end, said first and second ends defining a length of the snowboard extending in a longitudinal direction;

a first edge and a second edge, said first and second edges defining a width of the snowboard extending in a transverse direction;

an upper surface and a lower surface, said upper and lower surfaces defining a height of the snowboard;

between said first end and said second end, the snowboard further comprising a first end zone, a first contact line, a first intermediate zone, a first binding zone, a central zone, a second binding zone, a second intermediate zone, a second contact line, and a second end zone;

within said height of the snowboard, the snowboard further comprising at least one lower reinforcement, at least one upper reinforcement, and at least one core, said core being located between said upper reinforcement and said lower reinforcement and having opposite ends defining a length of said core, said core comprising a thickness demarcated by two surfaces, said thickness being constant from a first of said opposite ends to a second of said opposite ends, said core having a smaller width than said width of the snowboard in each of said first and second end zones, said core providing the snowboard with an upwardly projecting base portion to form an upper base surface;

at least in each of said first and second end zones said upper surface of the snowboard being defined by said upper base surface and a lower base surface, whereby at least in each of said first and second end zones said lower base surface extends laterally of said upper base surface on opposite lateral sides of said upper base surface, and whereby at least in each of said first and second end zones a width of said upper base surface relative to the width of the board is less than in predetermined other ones of said zones.

10. A snowboard according to claim 9, wherein said core has a symmetrical shape with respect to a longitudinal median plane of the snowboard, said core extending widthwise from the longitudinal median plane, on both sides of the longitudinal median plane.

11. A snowboard according to claim 9, wherein at least in one of said intermediate zones said core has a smaller width than said width of the snowboard.

12. A snowboard according to claim 9, wherein said core widens out from each of said opposite ends to a respective one of said binding zones the closest to respective ones of said opposite ends.

13. A snowboard according to claim 9, wherein said core includes opposite ends, and said core has a narrowing toward a middle of said opposite ends.

14. A snowboard according to claim 9, further comprising a base plate projecting with respect to a base surface, said base plate having a shape substantially the same as a shape of said core.

15. A snowboard according to claim 9, wherein said reinforcements have a substantially constant thickness.

16. A snowboard according to claim 9, wherein said core is made of wood having fibers extending in a direction of said thickness of said core.

17. A snowboard according to claim 9, wherein said core is made of metal having a honeycomb shape.

18. A snowboard according to claim 17, wherein said metal is aluminum.

19. A snowboard according to claim 9, wherein in each of said end zones the width of said core is between 20% and 60% of the width of the board.

20. A snowboard according to claim 9, wherein in each of said intermediate zones the width of said core is between 40% and 80% of the width of the board.

21. A snowboard according to claim 9, wherein in each of said boot retaining zones the width of said core is between 75% and 100% of the width of the board.

22. A snowboard according to claim 9, wherein in said central zone the width of said core is between 50% and 90% of the width of the board.

23. A snowboard according to claim 9, wherein in each of said end zones the width of said core is between 20% and 60% of the width of the board, in each of said intermediate zones the width of said core is between 40% and 80% of the width of the board, in each of said boot retaining zones the width of said core is between 75% and 100% of the width of the board, and in said central zone the width of said core is between 50% and 90% of the width of the board.

24. A snowboard according to claim 9, wherein said first edge and second edge are formed by first and second running edges at outer extremities of a lowermost portion of the board, wherein said lower surface of the board is formed by a gliding sole extending in the transverse direction between said first and second running edges, and wherein in each of said first and second end zones said core has opposite edges spaced transversely from respective ones of said first and second running edges.

* * * * *